US010597915B2

(12) United States Patent
Biernat

(10) Patent No.: US 10,597,915 B2
(45) Date of Patent: Mar. 24, 2020

(54) LOCKING MECHANISM

(71) Applicant: Hamilton Sundstrand Corporation, Charlotte, NC (US)

(72) Inventor: Marcin Biernat, Bozkow (PL)

(73) Assignee: HAMILTON SUNDSTRAND CORPORATION, Charlotte, NC (US)

( * ) Notice: Subject to any disclaimer, the term of this patent is extended or adjusted under 35 U.S.C. 154(b) by 328 days.

(21) Appl. No.: 15/597,369

(22) Filed: May 17, 2017

(65) Prior Publication Data

US 2017/0335607 A1 Nov. 23, 2017

(30) Foreign Application Priority Data

May 17, 2016 (EP) ..... 16461523

(51) Int. Cl.

| | |
|---|---|
| ***E05C 3/00*** | (2006.01) |
| ***E05C 3/34*** | (2006.01) |
| ***E05B 63/12*** | (2006.01) |
| *E05B 47/00* | (2006.01) |

(52) U.S. Cl.

CPC ..... *E05C 3/002* (2013.01); *E05B 63/123* (2013.01); *E05C 3/34* (2013.01); *E05B 2047/0023* (2013.01)

(58) Field of Classification Search

CPC ..... Y10T 24/45293; Y10T 292/1047; Y10T 292/0862; Y10T 24/45628; Y10T 24/45644; Y10T 24/45702; Y10T 24/45749; Y10T 292/081; E05C 3/34; F16B 45/06; F16B 2/10

See application file for complete search history.

(56) References Cited

U.S. PATENT DOCUMENTS

| | | | | |
|---|---|---|---|---|
| 658,418 A | | 9/1900 | Appleton | |
| 2,736,599 A | * | 2/1956 | Coffing | B66C 1/34 294/82.31 |
| 5,072,973 A | | 12/1991 | Gudgel et al. | |
| 5,193,861 A | * | 3/1993 | Juga | E05C 3/34 292/207 |

(Continued)

FOREIGN PATENT DOCUMENTS

EP 1335088 A2 8/2003

OTHER PUBLICATIONS

Extended European Search Report for EP Application No. 16461523.9 dated Nov. 3, 2016, 7 pages.

*Primary Examiner* — Mark A Williams
(74) *Attorney, Agent, or Firm* — Cantor Colburn LLP

(57) ABSTRACT

A locking mechanism comprises a base comprising a pair of arms projecting therefrom and defining an open mouthed recess for receiving a member to be selectively retained in the recess. The mechanism further comprises a pair of locking elements mounted between said pair of arms for rotational movement between a retracted position in which they permit access to the recess and an extended position in which they extend at least partially across the mouth of the recess. The arms comprise respective guides to guide the movement of said locking elements between said retracted and extended positions. The mechanism further comprises a drive for simultaneously moving the locking elements in opposite rotational directions. The drive may comprise a drive shaft having left handed and right handed threaded portions.

19 Claims, 6 Drawing Sheets

(56) References Cited

U.S. PATENT DOCUMENTS

| | | | | |
|---|---|---|---|---|
| 5,209,530 | A | 5/1993 | Kolloch | |
| 5,901,990 | A * | 5/1999 | McMillan | B63B 21/04 292/195 |
| 5,915,766 | A * | 6/1999 | Baumeister | B04B 7/06 292/201 |
| 6,301,783 | B1 | 10/2001 | Deavers | |
| 6,654,990 | B2 * | 12/2003 | Liu | F16B 45/025 24/598.5 |
| 6,942,259 | B2 * | 9/2005 | Marzolf | E05B 85/247 292/216 |
| 7,527,093 | B2 | 5/2009 | Mosing et al. | |
| 8,033,233 | B2 | 10/2011 | Strong | |
| 8,047,585 | B1 * | 11/2011 | Peabody | E05B 47/0046 292/340 |
| 8,827,327 | B2 * | 9/2014 | Kutschat | E05B 85/247 292/196 |
| 9,702,167 | B2 * | 7/2017 | Liao | E05B 47/0004 |
| 2004/0113441 | A1 * | 6/2004 | Lane | E05B 85/10 292/336.3 |
| 2009/0134638 | A1 * | 5/2009 | Kutschat | E05B 85/247 292/216 |

* cited by examiner

LOCKING MECHANISM

FOREIGN PRIORITY

This application claims priority to European Patent Application No. 16461523.9 filed May 17, 2016, the entire contents of which is incorporated herein by reference.

TECHNICAL FIELD

The present disclosure relates to a locking mechanism as might be used, for example, in locking a door or other movable element.

BACKGROUND

A large number of locking mechanisms are known. In certain locking mechanisms, one or more locking elements move from a retracted position in which the mechanism allows an element such as a shaft to be moved and an extended position in which movement of the element is blocked. Such mechanisms, particularly for applications such as aircraft applications, must be reliable and, if possible lightweight.

SUMMARY

A locking mechanism in accordance with this disclosure comprises a base defining an open mouthed recess for receiving a member to be selectively retained in the recess. The mechanism further comprises a pair of locking elements mounted for rotational movement between a retracted position in which they permit access to the recess and an extended position in which they extend at least partially across the mouth of the recess. The mechanism further comprises a drive for simultaneously moving the locking elements in opposite rotational directions.

The mechanism may further comprise at least one arm, for example a pair of arms projecting from the base. The locking elements may be mounted between the pair of arms for rotational movement between the retracted and extended positions. The arm or arms may comprise respective guides to guide the movement of the locking element between the retracted and extended positions.

The locking elements may comprise guide elements for engagement with the guides provided on the arms.

The guides may comprise arcuate channels formed in the arm (s), and the locking elements may comprise guide pins for engagement with the channels.

Each locking element may comprise at least two guide pins extending into a respective guide channel.

The guides may extend over an arc of, for example, from 190-210°. In a particular example, the guides may extend 200°.

The locking elements may be rotatable over an arc of, for example, about 80-100°. In a particular example, the locking elements may be rotatable over an arc of 90°.

In various embodiments, tips of the locking elements may overlap one another when the locking elements are in their extended positions.

The arms may each comprise a pair of elements between which a respective locking element is mounted.

Each of the pair of elements may then comprise a guide channel, with the respective locking element having respective guide pins extending into said guide channels.

In various embodiments, the arms are arcuate. Alternatively or additionally, the locking elements may be arcuate.

In various embodiments, the locking elements may be shielded by the arms in their retracted position.

In various embodiments, the drive comprises a rotary drive shaft having a right handed thread portion for driving one locking element and a left handed thread portion for driving the other locking element.

The threaded portions of said drive shaft may be coupled to the respective locking elements through a drive element. The drive element may have a treaded nut portion for engaging the drive shaft and a lost motion coupling to the locking element.

The lost motion coupling may be a slot, and the locking element may have a drive pin received in the slot. The slot permits linear movement of the drive pin along the slot during rotational movement of the locking elements.

BRIEF DESCRIPTION OF DRAWINGS

Some embodiments of the disclosure will now be described, by way of example only, with reference to the accompanying figures in which.

DETAILED DESCRIPTION

Figure 1:
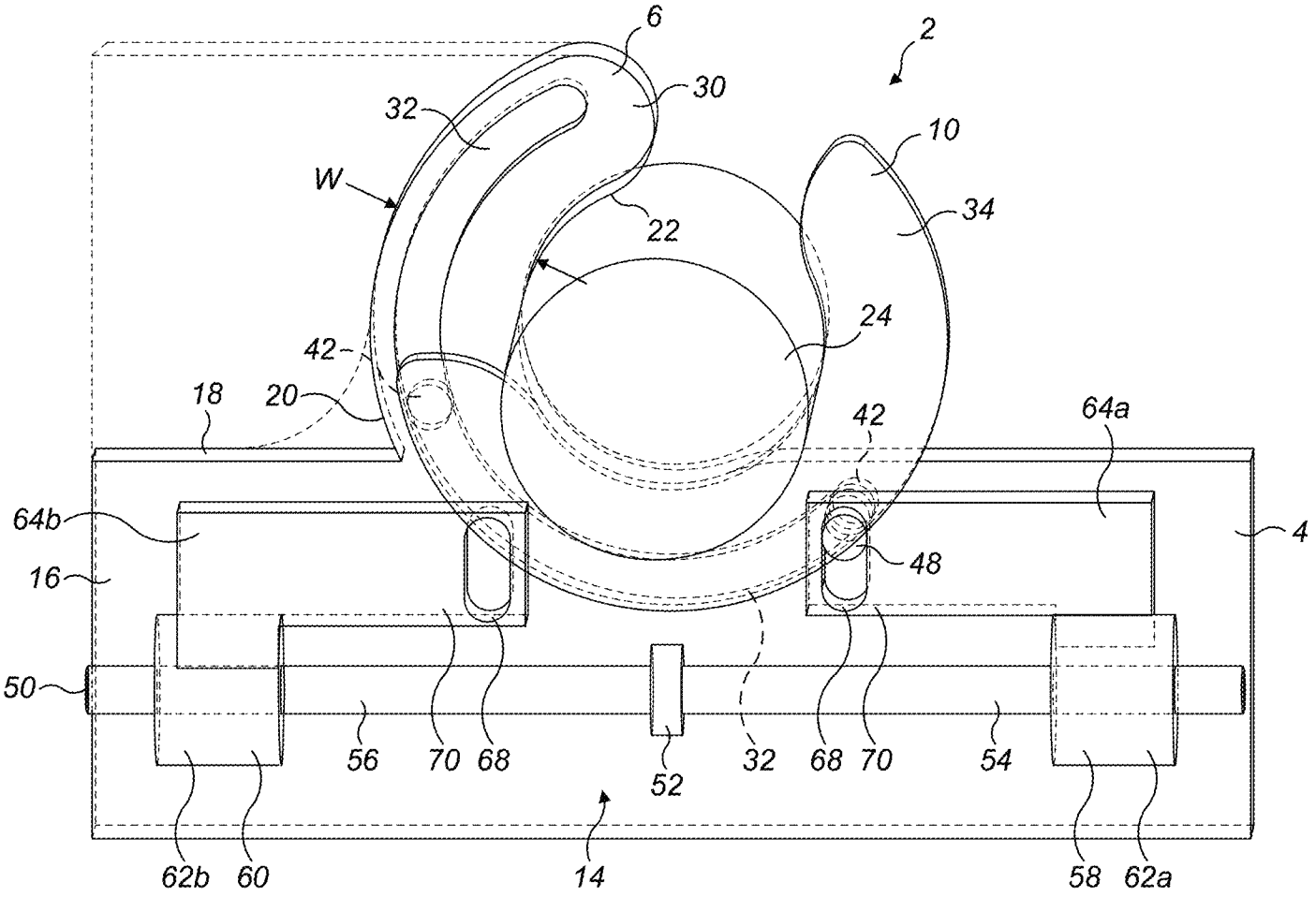
FIG. 1 is a schematic sectional view of a first embodiment of the disclosure.
Figure 2:
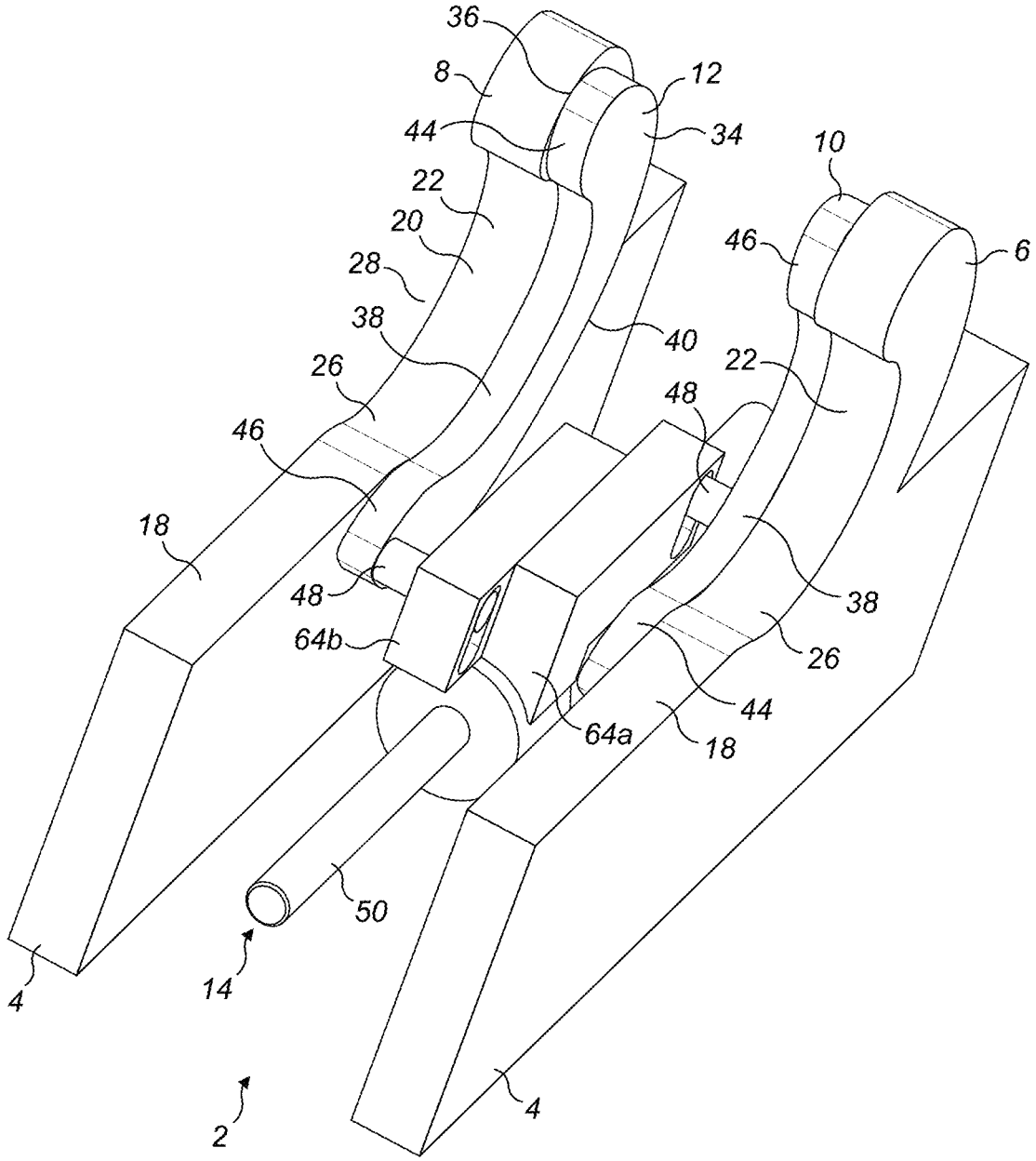
FIG. 2 is a perspective view of the embodiment of FIG. 1 in an unlocked condition.
Figure 3:
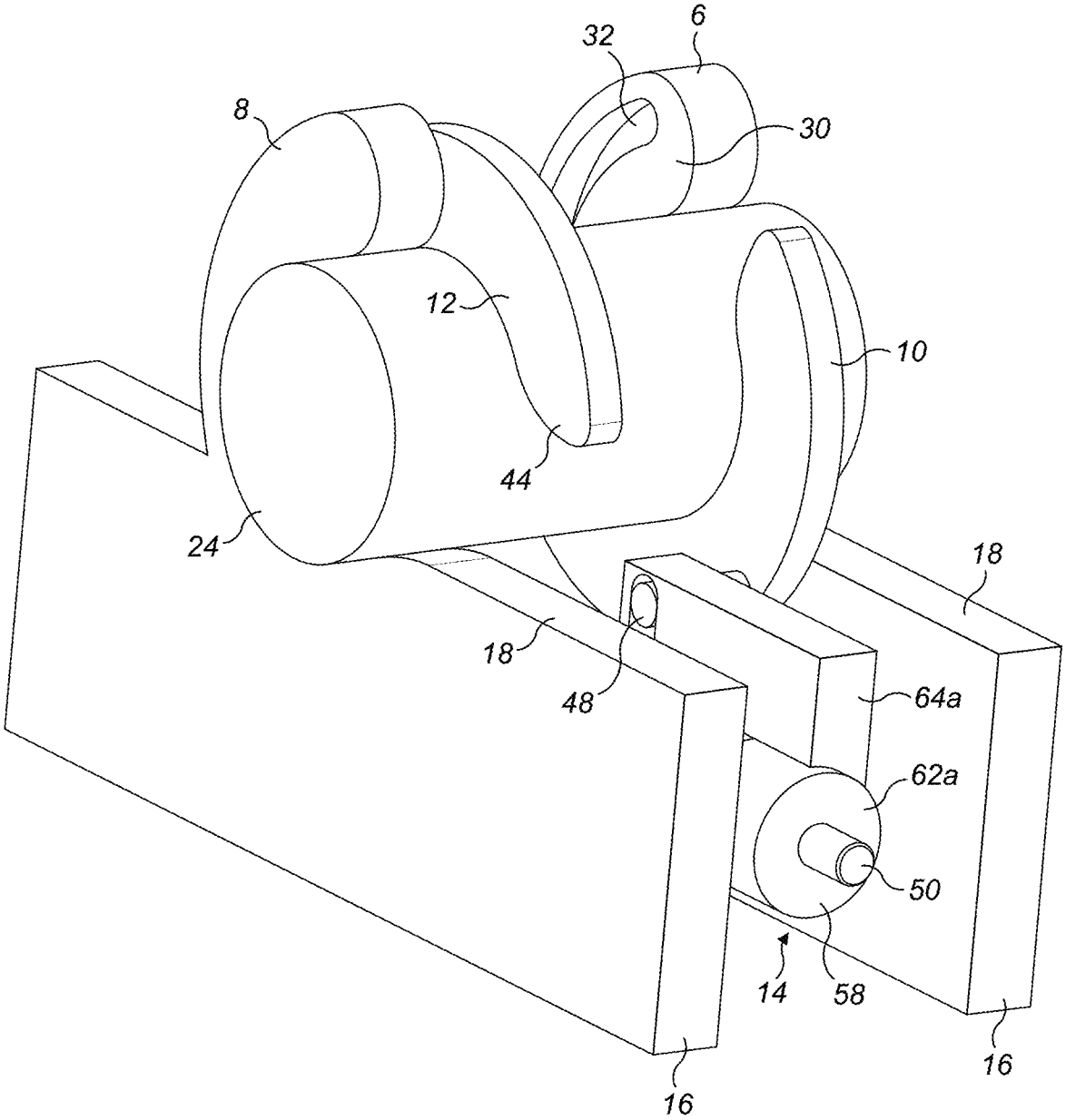
FIG. 3 is a perspective view of the embodiment of FIG. 1 in a locked condition.

With reference to FIGS. 1 to 3, a first locking mechanism 2 in accordance with the disclosure is illustrated.

The locking mechanism 2 comprises a base 4 including a pair of arms 6, 8, a pair of locking elements 10, 12 and a drive 14.

The base 4 comprises a pair of base plates 16 the respective arms 6, 8 extending upwardly from the upper surface 18 of each base plate 16. The base plates 4, 6 are shown as separate elements in this embodiment, but they will be suitably attached together by suitable means not shown. Other forms of base construction may be readily envisaged.

The arms 6, 8 are somewhat hook-like in shape. They are, in this embodiment arcuate in shape and extend in a circular arc from the upper surfaces 18 of the base plates 16 over an exemplary arc of approximately 65°. Of course, the arc covered may be different, for example in the range 60-70°. Although each of the arms 6, 8 is shown as having a generally constant width W, in some embodiments, the base end 20 thereof may be wider, as illustrated by dotted lines in FIG. 1, to facilitate manufacture and for strength. In other embodiments, the arms 6, 8 may simply be formed as an upper part of the base 4 as illustrated schematically in double dotted nines.

In this embodiment, the inner edge surfaces 22 of the arms 6, 8 are arcuate in order to receive a circular section member 24 such as a shaft 24 which is to be retained by the locking mechanism 2. The profile of the inner edge surfaces 22 may be chosen to match that of the element 24, should the element 24 have a non-circular profile. The upper surface 18 of each base plate 16 is provided with a shallow groove 26 which smoothly continues the profile of the inner edge surfaces 22 of the arms 6, 8. The arms 6, 8 and base plates 16 define an open mouthed recess 28 to receive the member 24.

The inner wall 30 of each arm 6, 8 comprises an arcuate guide 32 in the form of a channel 32 which extends downwardly into the respective base plates 16, 18. In this embodiment, the channel 32 is formed as a groove, but it may also be formed as a through slot in other embodiments. The channel 32 may typically extend around an arc of approximately 190-210°, for example around 200°. As will be explained further below, the channel 32 will guide the movement of the locking elements 10, 12.

The locking elements 10, 12 are sandwiched between the arms 6, 8. In the views of FIGS. 2 and 3, the base plates 16 have been moved apart for purposes of explanation, but in practice, the base plates 16 will be closer together, thereby retaining the locking elements 10, 12 in position.

Each locking element 10, 12 is arcuate in shape having opposed inner and outer planar faces 34, 36, and inner and outer edges 38, 40. The inner edges 38 are arcuate in shape and generally match the contour of the shaft 24 and the inner edge surface 22 of the arms 6, 8. A pair of guide pins 42 extends outwardly from the outer planar surface 36 of each locking element 10, 12. The guide pins 42 are received in the channel 32 provided on the inner wall 30 of the adjacent arm 6, 8. The guide pins 42 are separated by an arc of about 90-120°, for example 110°. Not only will the guide pins 42 guide the movement of the locking elements 10, 12, they will also abut the ends of the channels 32 to provide stops for the locking elements 10, 12. The separation of the guide pins 42 therefore determines the maximum range of movement of the locking elements 10, 12.

The locking elements 10, 12 each comprise a tip 44 and a root 46. The tip 44 of a first locking element 10 is, as illustrated in FIG. 2, located adjacent the base plate 16 when it is retracted. The root 46 of the first locking element 10 is located adjacent the adjacent arm 6. In contrast, the tip 44 of the second locking element 12 is located adjacent the arm 8, with its root 46 located adjacent the adjacent base plate 16.

As can be seen from FIG. 2, in the retracted position, the locking elements 10, 12 are substantially shielded or covered by the arms 6, 8 which may prevent inadvertent damage thereto.

One guide pin 42 of the first locking element 10 is positioned at the root 46 of that element 10. The other guide pin 42 is located approximately half way between the root 46 and the tip 44.

One guide pin 42 of the second locking element 12 is positioned at the tip 44 of that element 12. The other guide pin 42 is located approximately half way between the root 46 and the tip 44.

Respective drive pins 48 extend inwardly from the inner planar surface 34 of the respective locking element 10, 12. The drive pin 48 of the first locking element 10 may be located generally opposite the guide pin 42 located intermediate the ends of the first locking element 10. The drive pin 48 of the second locking element (12) may be located generally opposite the guide pin 42 located adjacent the root 46 of the second locking element (12). Other positions of the drive pins 48 will of course be possible, depending on the particular layout and range of motion required of the locking elements 10, 12.

The drive pins 48 are coupled to the drive 14 to drive the respective locking elements 10, 12.

The drive 14 comprises a rotary drive shaft 50 which is driven, in this embodiment, by gear 52. The drive gear 52 may, for example, be a pinion gear or a worm gear driven by suitable means. The drive shaft 50 has a first threaded portion 54 and a second threaded portion 56. The first threaded portion 54 has a right hand thread and the second threaded portion 56 has a left hand thread in this embodiment. Of course the thread directions may be reversed. What is important is that the two threaded portions 54, 56 have an opposite thread.

First and second drive elements 58, 60 are mounted to the first and second threaded portions 54, 56 respectively. Drive element 58 comprises a nut portion 62*a* and a link portion 64*a* extending from the nut portion 62*a* towards the gear 52. Drive element 60 comprises a nut portion 62*b* and a link portion 64*b* extending from the nut portion 62*b* towards the gear 52. The nut portion 62*a* has a right handed internal thread which matches the thread of the threaded portion 54 of the shaft 50 to which it is mounted. The nut portion 62*b* has a left-handed internal thread which matches the thread of the threaded portion 56 of the shaft 50 to which it is mounted. The link portions 64*a*, 64*b* are mounted to the respective nut portions 62*a*, 62*b* at a proximal end 66 and each is formed with a slot coupling 68 at its distal end 70. The drive pin 48 of the adjacent locking element is received in the slot 68. The slot 68 acts as a lost motion mechanism as will be discussed further below.

Having described the structure of the locking mechanism 2, its operation will now be described.

In the open position shown in FIG. 2, the recess 28 defined between the arms 6, 8 and the base 4 is fully open, the locking elements 10, 12 being fully retracted to lie adjacent the arms 6, 8. In this condition, the respective link portions 64*a*, 64*b* of the drive 14 overlap one another as can be seen from FIG. 2. In this open position, a member to be retained, such as the shaft 24 may be located within the recess 28, as illustrated schematically by the arrow A in FIG. 2. The shaft 24 may, for example, be attached to a pivotally mounted member such as a door or cover and may act to hold the member in a closed position. The shaft 24 is received in the recess 28 and may contact the inner surface 22 of the arms 6, 8.

When it is desired to lock the shaft 24 in position such that it cannot be withdrawn from the recess 28, the drive 14 is operated. The gear 52 is rotated in one direction and, due to the different threading on the respective threaded portions 54, 56 of the drive shaft 50 and the nut portions 62*a*, 62*b* of the drive elements 58, 60, the respective drive elements 58, 60 move in opposite directions away from one another along the drive shaft 50.

The motion of the drive elements 58, 60 is transmitted to the locking elements 10, 12 via the slots 68 in the link portions 66 and the drive pins 48 attached to the locking elements 10, 12. The drive pins 48 move the respective locking elements 10, 12 along the guide channels 32 in the arms 6, 8. The guide pins 42 guide the locking elements 10, 12 to move in an arcuate path along the channels 32. It will be appreciated that due to this arcuate path, the drive pins 48 will not only move horizontally relative to the base 4, but will be forced to move vertically as well. However, the slots 68 accommodate this movement as a lost motion mechanism, permitting linear movement of the drive pins 42 along the slots 68 during angular movement of the locking elements 10, 12.

The first locking element 10 rotates counter-clockwise in the sense of FIG. 1 such that its tip 44 extends above the base plate 16. In contrast, the second locking element 12 rotates counter-clockwise such that its tip 44 extends beyond the adjacent arm 8. Both locking elements 10, 12 follow a circular path and thus wrap around the shaft 24 from different directions, as shown in FIG. 3. It will be seen that the tips 44 of the locking elements 10, 12 overlap such that the shaft 24 is engaged over a full 360° providing improved retention of the shaft 24 in the recess 28.

The locking elements 10, 12 will stop when the drive shaft 50 ceases to rotate. Suitable means such as sensors etc. may be provided to achieve stoppage in the correct position. Over-rotation of the locking elements 10, 12 is prevented by the guide pins 42 which will abut the ends of the guide channel 32. A suitable holding mechanism such as a brake may be provided in the drive 14 to avoid inadvertent movement of the drive shaft 50.

In this condition, the shaft 24 is firmly retained within the recess 28 and cannot be withdrawn therefrom. To permit withdrawal, the drive shaft 50 must be rotated in the opposite direction, which causes the rotation of the locking elements 10, 12 in the opposite direction, thereby returning them to their original positions, whereupon the shaft 24 can be withdrawn from the recess 28.

In the embodiment above, the locking elements 10, 12 are retained laterally in position by the drive elements 58, 60. These elements may therefore be provided with a low friction surface to allow sliding of the locking elements 10, 12 relative thereto.

Figure 4:
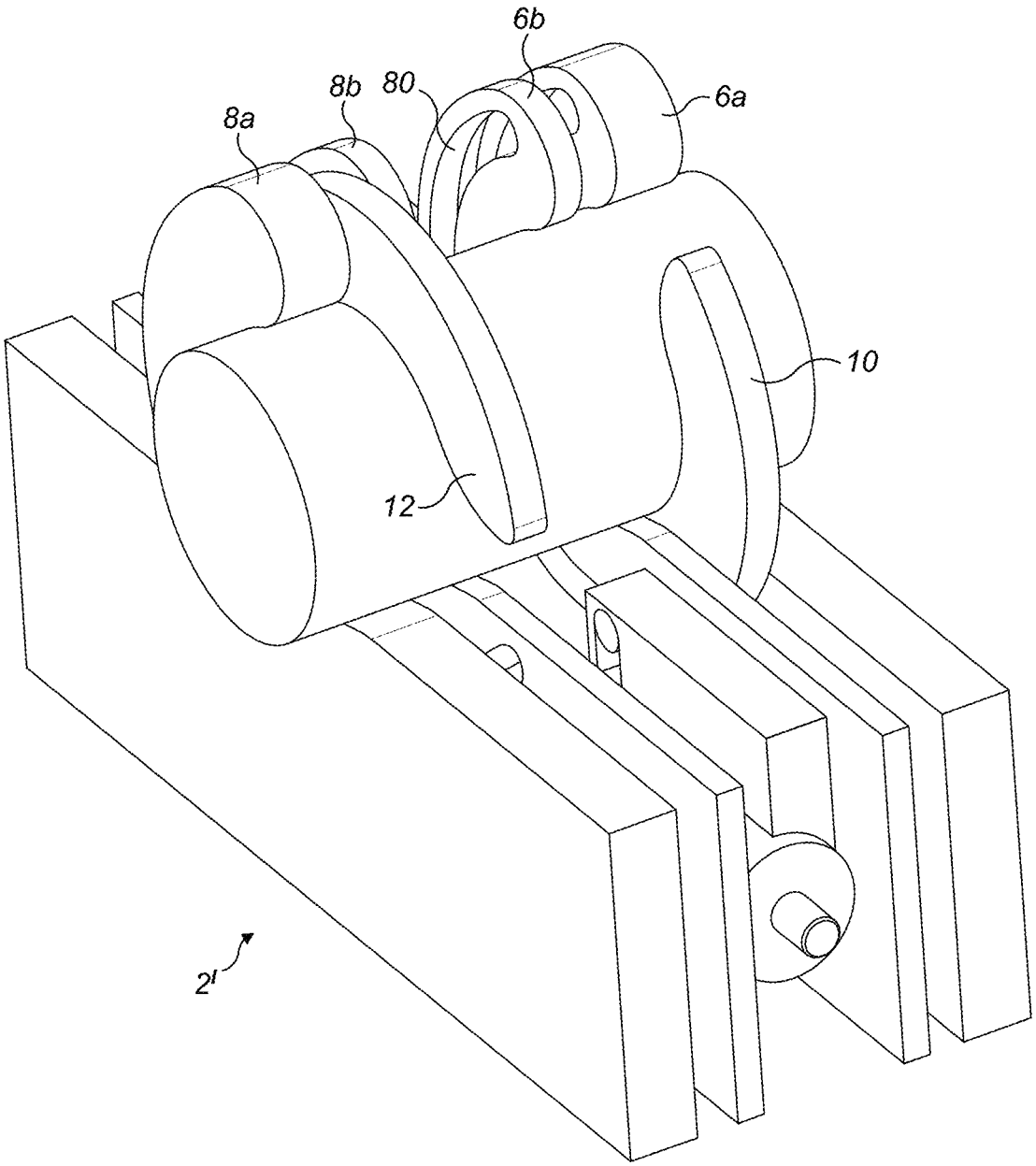
FIG. 4 is a perspective view of a second embodiment of the disclosure in a locked condition.
Figure 5:
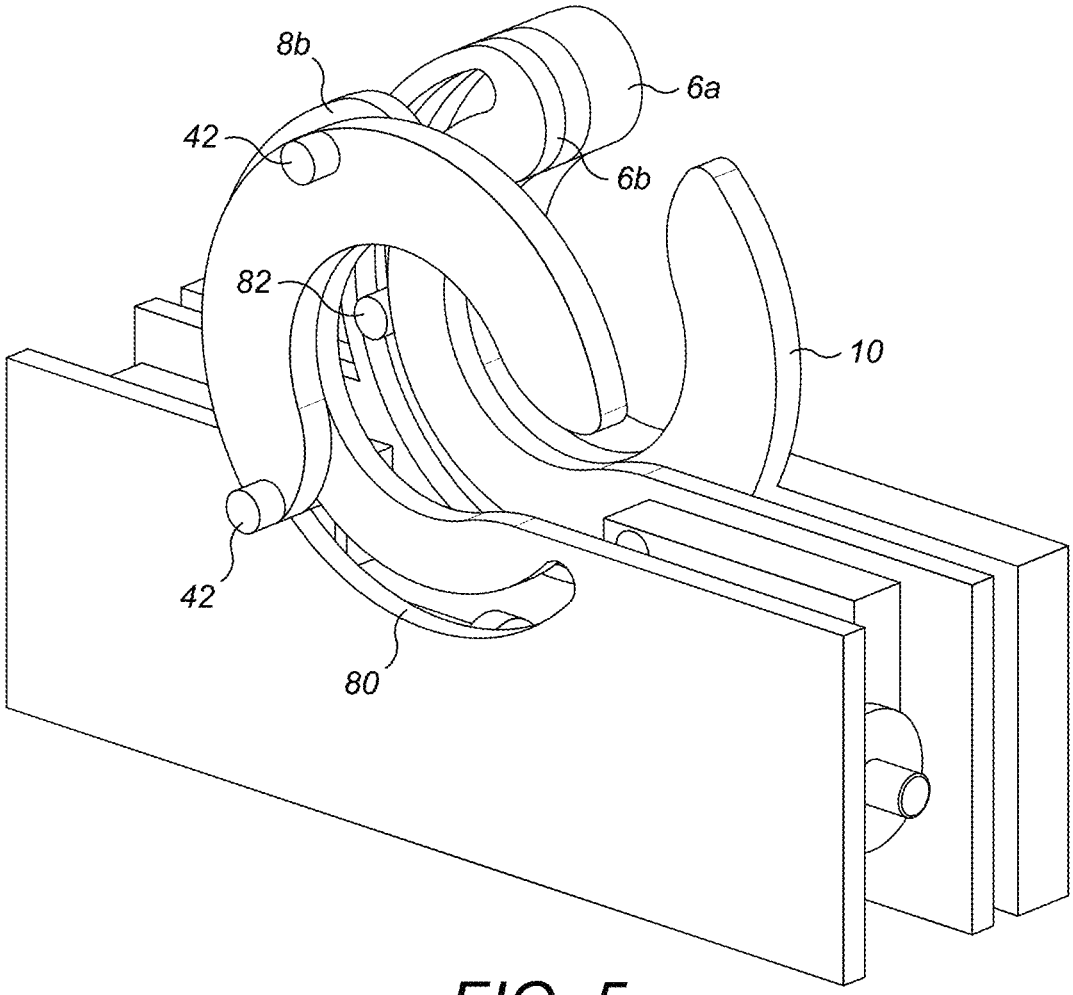
FIG. 5 is a perspective view of the embodiment of FIG. 4 with some components removed for purposes of explanation.
Figure 6:
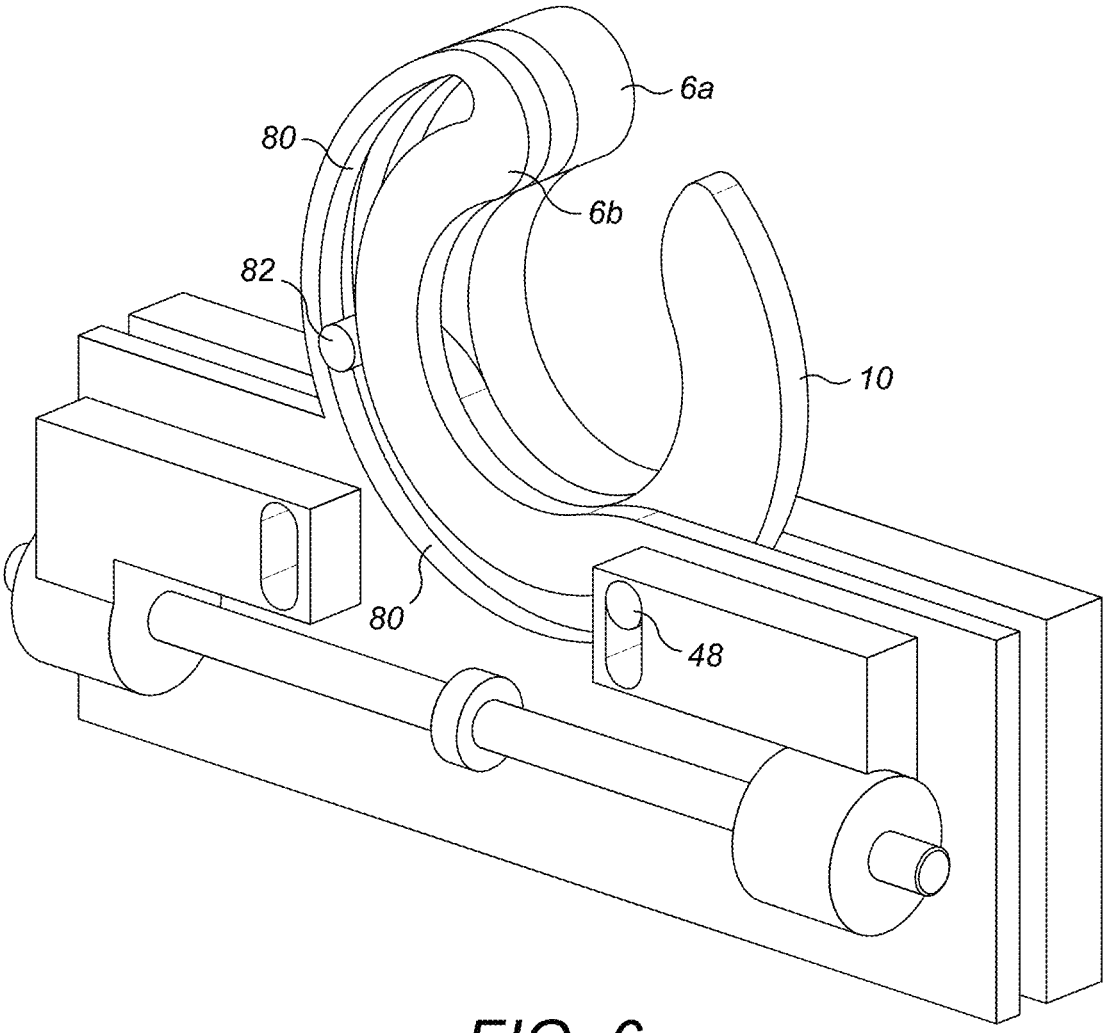
FIG. 6 is a view corresponding to FIG. 5, but with some further components removed for purposes of explanation.

FIGS. 4 to 6 show a second embodiment of locking mechanism 2' in accordance with the disclosure in which the locking elements 10, 12 are laterally located in an alternative manner. The basic construction of the second embodiment is similar to that of the first embodiment so only the differences therebetween will be described in detail.

In this embodiment, each arm 6, 8 comprises a first part 6*a*, 8*a* and a second part 6*b*, 8*b* spaced laterally from the first part 6*a*, 8*a*. Similarly each base plate 16 comprises a first part 16*a* and a second part 16*b* spaced laterally from the first part 16*a*. The first and second locking elements 10, 12 are located between the first and second parts.

The first parts 6*a*, 8*a*, 16*a* of the locking elements 6, 8 and the base plates 16 are similar in construction to the locking elements 6, 8 and base plates 16 of the first embodiment. The second parts 6*b*, 8*b*, 16*b* are formed with a through slot 80 aligned with the channels 32 in the first parts 6*a*, 8*a*, 16*a*.

Each movable locking member 10, 12 still comprises guide pins 42 on their outer surface 36 as in the earlier embodiment. However, each locking element comprises an additional guide pin 82, extending from its inner surface 34. This guide pin 82, together with the drive pin 48 pass through the slot 80. In this manner, the drive pin 48 also acts as a guide pin.

The operation of the locking mechanism of the second embodiment is the same as that of the first embodiment and need not therefore be described again.

The locking mechanism of the disclosed embodiments may be advantageous in providing a lightweight reliable mechanism using multiple locking elements to provide a locking effect.

It will be appreciated that the above embodiments are only exemplary and that various modifications may be made thereto without departing from the scope of the disclosure.

For example, other drive mechanisms may be provided, as long as they produce movement of the locking elements in opposite directions.

The invention claimed is:

1. A locking mechanism comprising:

a base defining an open mouthed recess for receiving a member to be selectively retained in the recess;

a pair of locking elements mounted for rotational movement between a retracted position in which they permit access to the recess and an extended position in which they extend at least partially across the mouth of the recess; and a drive for simultaneously moving the locking elements in opposite rotational directions;

wherein said base comprises at least one arm, said at least one arm comprising respective guides to guide the movement of said locking elements between said retracted and extended positions;

wherein said locking elements comprise guide elements for engagement with said guides and said guides comprise arcuate channels formed in said at least one arm; and wherein said locking elements comprise guide pins for engagement with said channels.

2. A locking mechanism as claimed in claim 1, comprising a pair of arms, said locking elements being mounted between said pair of arms.

3. A locking mechanism comprising:

a base defining an open mouthed recess for receiving a member to be selectively retained in the recess;

a pair of locking elements mounted for rotational movement between a retracted position in which they permit access to the recess and an extended position in which they extend at least partially across the mouth of the recess; and a drive for simultaneously moving the locking elements in opposite rotational directions;

wherein said base comprises at least one arm, said at least one arm comprising respective guides to guide the movement of said locking elements between said retracted and extended positions;

wherein said locking elements comprise guide elements for engagement with said guides and said guides comprise arcuate channels formed in said at least one arm; and wherein each said locking element comprises at least two guide pins extending into a respective guide channel.

4. A locking mechanism as claimed in claim 1, wherein said guides extend over an arc of from 190-210°.

5. A locking mechanism as claimed in claim 2, wherein said arms each comprise a pair of elements between which a respective locking element is mounted.

6. A locking mechanism comprising:

a base defining an open mouthed recess for receiving a member to be selectively retained in the recess;

a pair of locking elements mounted for rotational movement between a retracted position in which they permit access to the recess and an extended position in which they extend at least partially across the mouth of the recess; and a drive for simultaneously moving the locking elements in opposite rotational directions;

wherein said base comprises at least one arm, said at least one arm comprising respective guides to guide the movement of said locking elements between said retracted and extended positions;

wherein the locking mechanism comprising a pair of arms, said locking elements being mounted between said pair of arms; and wherein each of the pair of elements comprises a guide channel, with the respective movable element having respective guide pins extending into said guide channels.

7. A locking mechanism as claimed in claim 1, wherein said locking elements are rotatable over an arc of about 80-100°.

8. A locking mechanism as claimed in claim 1, wherein tips of said locking elements overlap one another when said locking elements are in their extended positions.

9. A locking mechanism as claimed in claim 1, wherein said locking elements and/or said arms are arcuate.

10. A locking mechanism as claimed in claim 1, wherein said drive comprises a rotary drive shaft having a right handed thread portion for driving one locking element and a left handed thread portion for driving the other locking element.

11. A locking mechanism as claimed in claim 10, wherein said threaded portions of said drive shaft are coupled to the respective locking elements through a drive element, said drive element having a treaded nut portion for engaging the drive shaft and a lost motion coupling to the locking element.

12. A locking mechanism as claimed in claim 11, wherein the lost motion coupling comprises a slot, said locking element having a drive pin received in said slot, said slot permitting linear movement of the drive pin along the slot during rotational movement of the locking elements.

13. A locking mechanism as claimed in claim 3, wherein said guides extend over an arc of from 190-210°.

14. A locking mechanism as claimed in claim 3, comprising a pair of arms, said locking elements being mounted between said pair of arms.

15. A locking mechanism as claimed in claim 14, wherein said arms each comprise a pair of elements between which a respective locking element is mounted.

16. A locking mechanism as claimed in claim 15, wherein each of the pair of elements comprises a guide channel, with the respective movable element having respective guide pins extending into said guide channels.

17. A locking mechanism as claimed in claim 3, wherein said drive comprises a rotary drive shaft having a right handed thread portion for driving one locking element and a left handed thread portion for driving the other locking element.

18. A locking mechanism as claimed in claim 17, wherein said threaded portions of said drive shaft are coupled to the respective locking elements through a drive element, said drive element having a treaded nut portion for engaging the drive shaft and a lost motion coupling to the locking element.

19. A locking mechanism as claimed in claim 6, wherein said drive comprises a rotary drive shaft having a right handed thread portion for driving one locking element and a left handed thread portion for driving the other locking element.

* * * * *